United States Patent [19]

Hayashi et al.

[11] Patent Number: 4,746,092

[45] Date of Patent: May 24, 1988

[54] APPARATUS FOR SUPPORTING AN ELECTRIC BLOWER OF A VACUUM CLEANER

[75] Inventors: Seizo Hayashi, Oumi Hachiman; Hidenori Kitamura, Yokaichi; Yuichi Shimizu, Oumi Hachiman, all of Japan

[73] Assignee: Matsushita Electric Industrial Co., Ltd., Kadoma, Japan

[21] Appl. No.: 14,615

[22] Filed: Feb. 13, 1987

[30] Foreign Application Priority Data

Feb. 14, 1986 [JP] Japan ..... 61-31474

[51] Int. Cl.[4] ..... H02K 5/24

[52] U.S. Cl. ..... 248/638; 15/412; 310/51

[58] Field of Search ..... 248/556, 560, 603, 604, 248/605, 606, 607, 610, 611, 634, 638, 27.3, 201; 310/51, 89; 415/119; 15/412

[56] References Cited

U.S. PATENT DOCUMENTS

| | | | |
|---|---|---|---|
| 1,778,992 | 10/1930 | Wulfert | 310/51 |
| 2,207,251 | 7/1940 | Guedon | 310/51 |
| 2,471,812 | 5/1949 | Christiano | 310/51 |
| 2,576,860 | 11/1951 | Shapiro | 415/119 |
| 2,615,617 | 10/1952 | Laltner | 415/119 |
| 2,928,632 | 3/1960 | Morrill | 310/51 |
| 3,114,060 | 12/1963 | Goettl | 310/51 |
| 3,154,704 | 10/1964 | Shaffer | 310/51 |
| 3,256,828 | 6/1966 | Rule | 310/51 |
| 3,285,547 | 11/1966 | Henry | 310/51 |
| 3,323,763 | 6/1967 | Butts | 310/51 |

FOREIGN PATENT DOCUMENTS

| | | | |
|---|---|---|---|
| 717857 | 9/1965 | Canada | 248/604 |
| 148669 | 7/1985 | European Pat. Off. | 310/51 |
| 660896 | 5/1938 | Fed. Rep. of Germany | 248/606 |
| 2558271 | 1/1977 | Fed. Rep. of Germany | 248/610 |
| 1124389 | 10/1956 | France | 248/634 |
| 53-46387 | 12/1978 | Japan . | |
| 54-43825 | 12/1979 | Japan . | |
| 528156 | 10/1940 | United Kingdom | 248/606 |
| 635589 | 4/1950 | United Kingdom | 248/610 |
| 659562 | 10/1951 | United Kingdom | 248/605 |
| 1000205 | 8/1965 | United Kingdom | 248/603 |

*Primary Examiner*—Ramon O. Ramirez
*Assistant Examiner*—Robert A. Olson
*Attorney, Agent, or Firm*—Cushman, Darby & Cushman

[57] ABSTRACT

Disclosed is an apparatus for supporting an electric blower of a vacuum cleaner, comprising a front supporting member positioned between the front surface of the electric blower and a housing of the vacuum cleaner and a rear supporting member positioned between the electric blower and the housing thereof. The rear supporting member is fixed to the electric blower and the housing to prevent the electric blower from being moved in its thrust direction. The rear supporting member is fixed thereto such that one end portion thereof is fixedly secured to the rear portion of the electric blower and a groove portion formed on the periphery of the rear supporting member is engaged with a fixing member protrudingly provided on the housing. The front supporting member is formed so that at least the cross section of a portion thereof positioned between the front surface of the electric blower and the housing of the vacuum cleaner has a wedge-like configuration.

7 Claims, 5 Drawing Sheets

APPARATUS FOR SUPPORTING AN ELECTRIC BLOWER OF A VACUUM CLEANER

BACKGROUND OF THE INVENTION

The present invention relates generally to a vacuum cleaner, and in particular to an apparatus for supporting an electric blower of a vacuum cleaner to provide vibration proofing operation.

An important problem in vacuum cleaners relates to the prevention of vibration. In order to avoid this problem it is known to support the front and rear surfaces of an electric blower with bumping members such as rubber member, as is disclosed in Japanese Patent Publication No. 54-43825. However, a front surface supporting member is compressed in the thrust direction of the electric blower because of the back pressure of the electric blower, resulting in the reduction of its resiliency and in decrease in vibration proof effect.

SUMMARY OF THE INVENTION

It is therefore an object of the present invention to provide a new and improved apparatus for supporting an electric blower which overcomes the above-mentioned disadvantage inherent to the prior art supporting apparatus.

In accordance with the present invention, there is provided an apparatus for supporting an electric blower of a vacuum cleaner, comprising a front supporting member positioned between the front surface of the electric blower and a housing of the vacuum cleaner and a rear supporting member positioned between the electric blower and the housing thereof, the rear supporting member being fixed to the electric blower and the housing to prevent the electric blower from being moved in its thrust direction.

Preferably, the front supporting member is formed so that at least the cross section of a portion thereof positioned between the front surface of the electric blower and the housing of the vacuum cleaner has a wedge-like configuration. This enables preventing the exhaust circulation due to the production of a gap between the suction side and the exhaust side of the electric blower caused by the fixing of the electric blower to the housing of the vacuum cleaner, because the portion with the wedge-like cross section is further intruded between the front surface of the electric blower and the housing by the aid of the back pressure of the electric blower. The prevention of the exhaust circulation results in the prevention of thermal deformation of the housing made of a resin.

BRIEF DESCRIPTION OF THE DRAWINGS

The present invention will be described in further detail with reference to the accompanying drawings, in which.

DETAILED DESCRIPTION OF THE INVENTION

Figure 1:
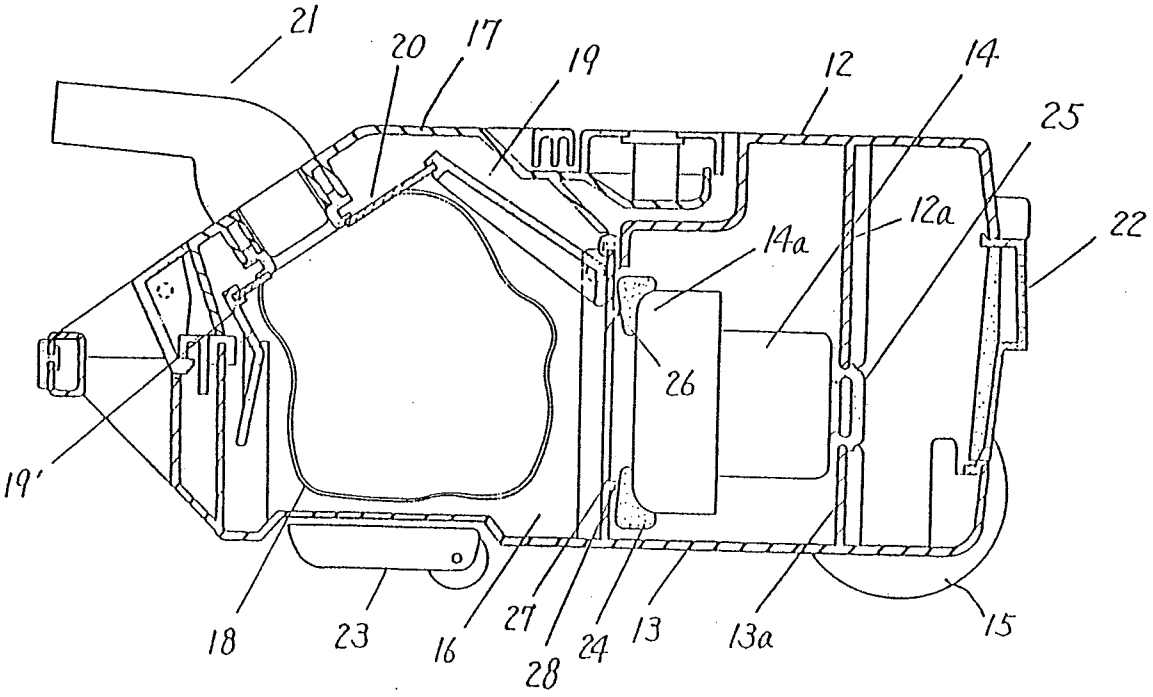
FIG. 1 is a cross-sectional view of a vacuum cleaner including an apparatus for supporting an electric blower according to the present invention.
Figure 2:
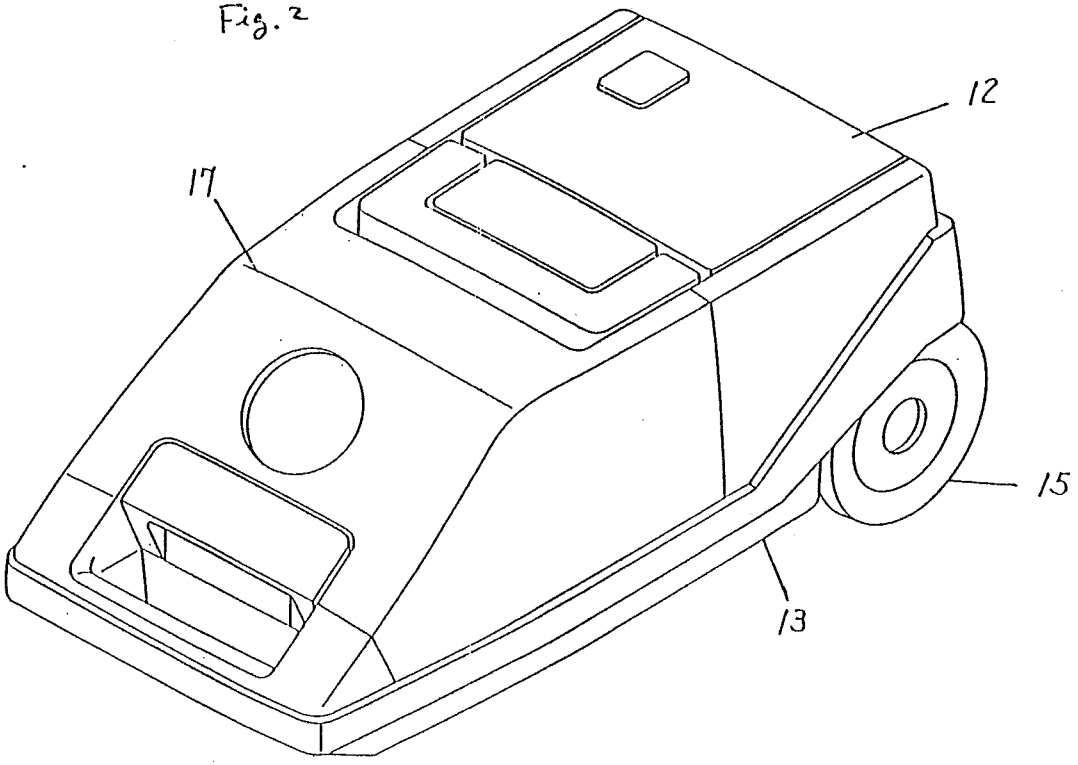
FIG. 2 is an illustration of the vacuum cleaner.
Figure 3:
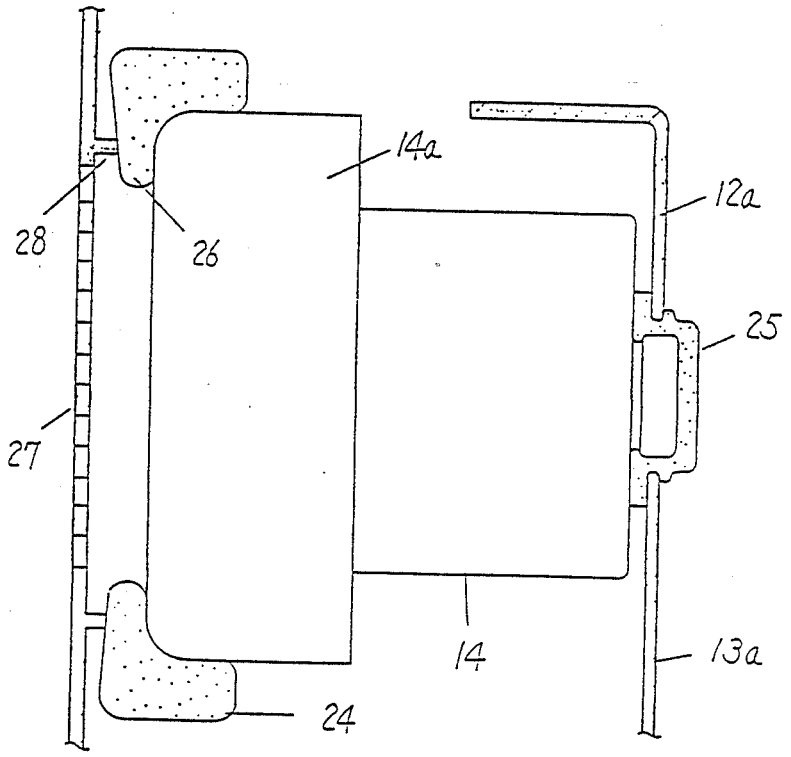
FIG. 3 is an enlarged cross-sectional view of the supporting apparatus according to an embodiment of this invention.

Referring now to FIG. 1, there is illustrated an apparatus for supporting an electric blower according to an embodiment of the present invention which is incorporated in a vacuum cleaner, which is shown in FIG. 2. FIG. 3 is an enlarged cross-sectional view showing the supporting apparatus.

In FIGS. 1 to 3, the vacuum cleaner includes an electric blower 14 encased in a housing comprising an upper housing section 12 and a lower housing section 13. To the lower housing section 13 are coupled a pair of wheels 15 and a caster 23 for carrying the body of the vacuum cleaner. The vacuum cleaner is arranged such that air and dust are intaken from a floor nozzle (not shown) through a suction port 21 to a dust chamber 16 defined at the suction side of the electric blower 14 and only dust is collected in a dust bag 18 provided in the dust chamber 16. The dust bag 18 acts as a filter for allowing only the passage of air. The air passes through the electric blower 14 and is discharged from an exhaust port 22. The dust chamber 16 has a cover 17 and a mouth plate 20 of the dust bag 18 is supported by a pair of supporting members 19 and 19'.

The electric blower 14 is arranged to be supported by the upper and lower housing sections 12 and 13 through front and rear supporting members 24 and 25. That is, the front supporting member 24 is interposed between an annular rib 28 provided on a bulkhead plate 27 fixed on the inner surface of the lower housing section 13 and the front surface of a fan portion 14*a* of the electric blower 14, and the rear supporting member 25 is interposed between protruding members 12*a*, 13*a* protrudingly provided on the upper and lower housing sections 12, 13 and the rear surface of the electric blower 14. The front supporting member 24, for example, is made of rubber for acting as a bumping member and formed by tubing foam rubber. The rear supporting member 25 may be made of rubber.

Figure 5:
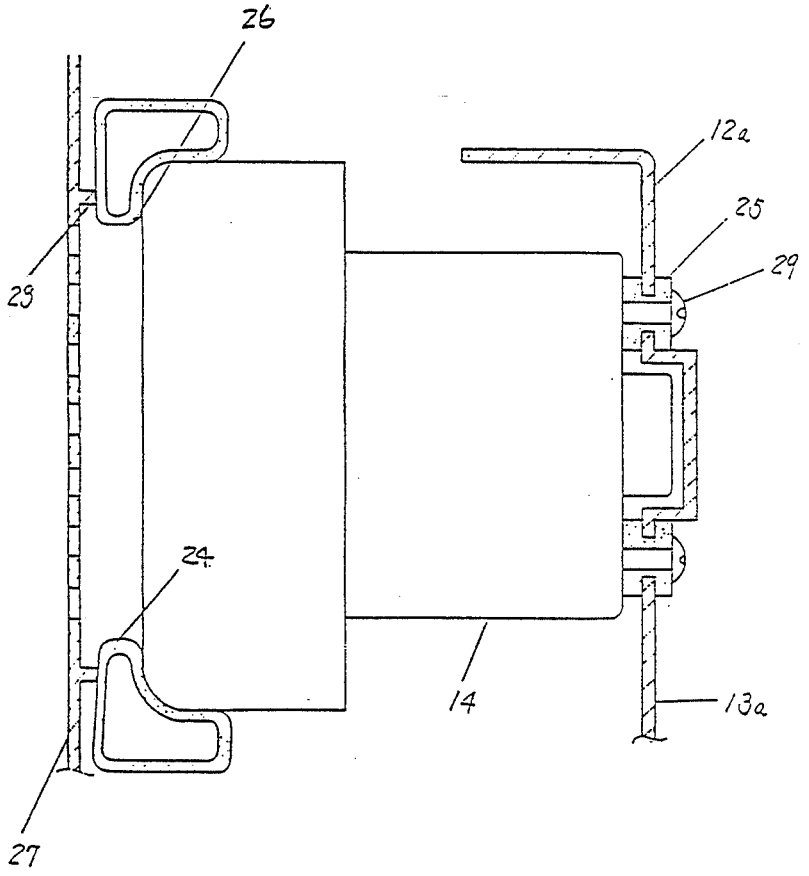
FIG. 5 is a cross-sectional view illustrating the other structure of the front supporting member.

More specifically, the front supporting member 24 is formed to have an annular configuration and to have substantially L-shaped cross-section. A portion 26 of the L-shaped front supporting member 24 extending to the center thereof has wedge-like cross-section and is provided between the annular rib 28 and the front surface of the fan section 14*a* of the electric blower 14. The other portion thereof is positioned on the periphery of the fan section 14*a*. With this arrangement of the front supporting member 24, the wedge-like portion 26 is further intruded therebetween with the other portion being under the back pressure of the electric blower 14 to always certainly ensure the airtightness between the annular rib 28 and the front surface of the fan section 14*a* and to prevent the thermal deformation due to exhaust circulation, irrespective of dispersion of the front supporting member 24 in dimension. It is also appropriate that the front supporting member 24 is hollow as shown in FIG. 5. The hollow supporting member will improve the vibration proofing effect.

Figure 4:
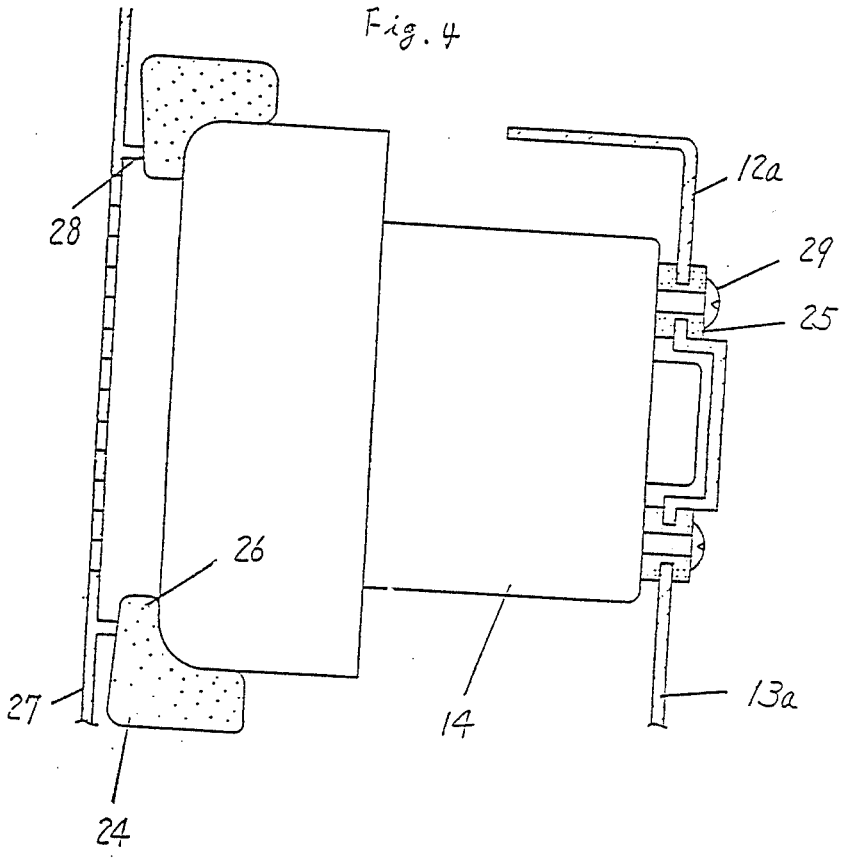
FIG. 4 is a cross-sectional view showing the other structure for fixing the electric blower of the vacuum cleaner.

On the other hand, one end portion of the rear supporting member 25 is fixed to the rear surface of the electric blower 14, and a groove portion is formed on the periphery thereof and one end portions of the protruding members 12*a* and 13*a* are engaged with the groove portion. That is, the electric blower 14 is fixedly supported through the rear supporting member 25 by the upper and lower housing sections 12 and 13. This prevents the electric blower 14 from being moved in the thrust direction by the back pressure of the electric blower 14, resulting in preventing the front supporting member 24 from being compressed and in ensuring the vibration proofing effect of the front supporting member 24 against the electric blower 14. It is also appropriate that the fixing of the electric blower 14 to the housing is performed as shown in FIG. 4. That is, the electric blower 14 is fixed through the rear supporting member 25 by screws 29. This more certainly prevents the movement of the electric blower 14 in the thrust direction.

It should be understood that the foregoing relates to only preferred embodiments of the present invention, and that it is intended to cover all changes and modifications if the embodiments of this invention herein used for the purpose of the disclosure, which do not constitute departures from the spirits and scope of this invention.

What is claimed is:

1. A vacuum cleaner having a housing and an electric blower having front and rear portions supported with respect to said housing by a supporting apparatus, said supporting apparatus comprising a front supporting member positioned between said front portion of said electric blower and said housing and a rear supporting member positioned between said rear portion of said electric blower and said housing, said front supporting member having a portion which is under a back pressure of said electric blower and said back pressure receiving portion having a cross section of a wedge-like configuration so as to be intruded by said back pressure between said blower rear portion and said front supporting member, said rear supporting member being fixed to said electric blower and said housing to prevent said electric blower from being moved in its thrust direction.

2. A vacuum cleaner as claimed in claim 1, wherein said front supporting member has a cross section of a substantially L-shaped configuration including the wedge-like configuration of said back pressure receiving portion, a portion other than said back pressure receiving portion being positiond on a periphery of said electric blower.

3. A vacuum cleaner as claimed in claim 1, wherein said front supporting member is hollow.

4. A vacuum cleaner as claimed in claim 1, wherein said front supporting member is made of rubber and is formed by tubing foam rubber material.

5. A vacuum as claimed in claim 1, wherein said portion of a wedge-like configuration is positioned between the front surface of said electric blower and a rib provided on a bulkhead plate protrudingly fixed to said housing.

6. A vacuum as claimed in claim 1, wherein said rear supporting member is fixed to said housing such that a groove portion on the periphery thereof is engaged with a fixing member protrudingly fixed to said housing.

7. A vacuum cleaner as claimed in claim 1, wherein said electric blower is fixedly secured by a screw to a fixing member protrudingly fixed to said housing with said rear supporting member being interposed between said screw and said fixing member.

* * * * *